US005759306A

United States Patent [19]

Tosaka et al.

[11] Patent Number: 5,759,306

[45] Date of Patent: Jun. 2, 1998

[54] METHOD FOR MAKING A STEEL SHEET SUITABLE AS A MATERIAL FOR CAN MAKING

[75] Inventors: Akio Tosaka; Kaneharu Okuda; Toshiyuki Kato; Hideo Kuguminato, all of Chiba, Japan

[73] Assignee: Kawasaki Steel Corporation, Japan

[21] Appl. No.: 613,879

[22] Filed: Mar. 11, 1996

[30] Foreign Application Priority Data

Mar. 10, 1995 [JP] Japan ..... 7-050958

[51] Int. Cl.[6] ..... C21D 8/02; C22C 38/00

[52] U.S. Cl. ..... 148/603; 148/650; 148/320

[58] Field of Search ..... 148/603, 650, 148/320

[56] References Cited

U.S. PATENT DOCUMENTS 5,360,676 11/1994 Kuguminato et al. ..... 148/603

FOREIGN PATENT DOCUMENTS 556834 8/1993 European Pat. Off. ..... 148/603

63310924 12/1988 Japan ..... 148/603

405202422 8/1993 Japan ..... 148/603

*Primary Examiner*—Deborah Yee

*Attorney, Agent, or Firm*—Austin R. Miller

[57] ABSTRACT

A method is provided for making a steel sheet suitable as a can material. The method includes a step for hot rolling a steel slab to a strip having a thickness of less than about 1.2 mm, a step for coiling the strip into a coil at a temperature range between about 600° and 750° C., a step for pickling the coil with an acid, and a step for cold rolling the coil at a rolling reduction rate of about 50 to 90 percent, wherein the steel slab contains about 0.0020 weight percent or less of carbon,
about 0.020 weight percent or less of silicon,
about 0.50 weight percent or less of manganese,
about 0.020 weight percent or less of phosphorus,
about 0.010 weight percent or less of sulfur,
about 0.150 weight percent or less of aluminum,
about 0.0050 weight percent or less of nitrogen, and
the balance iron and incidental impurities.

A steel sheet suitable as a can material is also provided by this method.

20 Claims, 1 Drawing Sheet

METHOD FOR MAKING A STEEL SHEET SUITABLE AS A MATERIAL FOR CAN MAKING

BACKGROUND OF THE INVENTION

1. Field of the Invention

The present invention relates to a method for making a steel sheet suitable for use in cans. The steel sheets produced in accordance with the method of the invention have excellent formability and are well suited for tin-plating (electro-tin plating), chromium plating (tin-free steels), and the like. In particular, the present invention relates to a method for making a steel sheet suitable for use in cans in which the can-making process is carried out after a low-temperature treatment, such as coating-baking.

2. Description of the Related Art

Cans produced and consumed in the largest quantities, e.g., beverage cans, 18-liter cans, and pale cans, are generally classified as either two-piece cans or three-piece cans. A two-piece can consists of two sections, i.e., a main body and a lid, in which the main body is formed either by shallow drawing, drawing and wall ironing (DWI), or Drawing and Redrawing (DRD) a steel sheet after having been surface treated. Such surface treatments include tin-plating, chromium-plating, chemical treatment and oil coating.

A three-piece can consists of three sections, namely, a main body and top and bottom lids. A three-piece can is constructed by bending a surface treated steel sheet to a cylindrical or prismatic shape, connecting the ends of the steel sheet, and then assembling the top and bottom lids.

Two-piece and three-piece cans both use a surface treated steel sheet manufactured by annealing a hot steel slab, pickling the slab, cold rolling the slab into a sheet, followed by annealing, temper rolling, surface treating and shearing of the sheet. Coating and baking of the surface treated steel sheet had been conventionally carried out either before or after these steps. However, a coiled strip process has been used in production in which a coiled strip (as opposed to a sheet) is subject to heating/drying, such as a coating-baking or a hot-melt film laminating. The coiled strip process has lately attracted attention because of its contribution to the advancement of steel sheet process rationalization.

The coiled strip process is more efficient because it is a continuous process, thereby differing from the conventional process in which cut sheets are coated and baked. The advantage of the coiled strip process is especially realized when the sheet thickness is decreased or a harder sheet is used. Therefore, the coiled strip process has been hailed as representing the future of can making, particularly in light of the trend toward thinner, harder raw materials for cans. Processes for making cans in which films are continuously laminated on the coil are disclosed in, for example, Japanese Laid-Open Patent Nos. 5-111674 and 5-42605.

One of the essential features required for steel sheet used in this can-making process is improved mechanical properties after the coil is subject to hot-melt film lamination or coating-baking at approximately 200° to 300° C. as described above. Conventional coating-baking processes for the sheet include heat treatments at a relatively low temperature (around 170° C.) and for a long time (around 30 minutes). In contrast, the coiled strip in the coiled strip process is treated at a higher temperature, i.e., 200° to 250° C., for a shorter time, i.e., a few minutes, in the coating-baking process Since conventional steel sheets, e.g., low carbon aluminum killed steels, further harden during such an aging process, wrinkles and cracks form inevitably during the can-making process. Thus, an absence of hardening after coating-baking as well as additional softness for improved formability are now required for steel sheets used in cans.

Additionally, since the ratio of the material cost to the total production cost is rather high in a can-making process, there has been a strong demand for material cost reductions. Attempts at cost reduction have included decreasing the thickness of the steel sheet, and neck-in-shaping for the purpose of decreasing the diameter of the top lid.

Some other ideas for reducing costs have been proposed. For example, a continuous annealing step having a higher production efficiency, yield, and surface quality has been employed instead of a box annealing step having a poor production efficiency, yield, and surface quality. Japanese Examined Patent No. 63-10213 discloses such process. Further, a process for making softer steel sheets by continuous annealing is disclosed in Japanese Open-Laid Patent No. 1-52452 in which various steel sheets, each having a different hardness, are made by various combinations of working and aging after continuous annealing.

Elimination of the annealing step altogether in the process for making the ultra-low carbon steel sheet has been proposed for cost reduction in Japanese Open-Laid Patent 4-280926. However, in this method, the temperature range of the hot-rolling step for producing a soft steel sheet necessary for the can-making process is limited to the ferrite region, below the transformation point. Further, the coil must be subject to a heat-retention step in order to homogenize the material, resulting in decreased production efficiency which negatively affects cost reduction.

SUMMARY OF THE INVENTION

Accordingly, the object of the present invention is to solve various limitations set forth above in the can-making process which utilizes coating-baking or film lamination on a coiled strip.

It is an object of the invention to provide a steel sheet suitable for use in can making having a formability similar to the above prior art without limiting the temperature range during the hot-rolling step to the ferrite region, and without requiring a heat-retention step after the coiling step.

We have closely studied various characteristics required for can-suitable steel sheets in order to solve the problems set forth above. Those studies have revealed that the following material characteristics are required for both two-piece cans and three-piece cans:

1) r value: a high r value, while essential for the type of deep drawing used in automobile production, is not required for cans.
2) Ridging: Non-uniform deformation, such as ridging, is unacceptable in can production.
3) Structure: A fine structure is desirable for uniform workability.
4) Aging property: Aging property of a conventional, continuously annealed material (low-carbon aluminum-killed steel) can cause failures in the can-making step such as neck-in and flanging. However, unlike materials that are subject to box annealing, perfect aging is not required.
5) Ductility: Local ductility in high speed tension tests utilizing speeds ten to a hundred times higher than the usual tension test shows that there is a close correlation between local ductility and formability, such conditions being comparable to the conditions faced in a can-making process. High local ductility is required in can-making process.

6) Proper strength range: A level of strength is required of the raw steel sheet so as to maintain strength after can formation. However, excessive strength in the raw sheet causes unsatisfactory shapes and damage to the forming die during shaping. Since material produced through conventional processes, that is without an annealing step, exhibits excessively high strength and extremely poor ductility, it cannot be practically used in a can-making process. Therefore, the strength must be controlled to a proper range.

Based on such findings, the effects of the components of the steel and the conditions of hot rolling in an annealing-free process for making a steel sheet suitable of a can-making process have been investigated. The investigations were carried out using a manufacturing-grade hot rolling apparatus because of the difficulty of laboratory simulations. As a result, it has been found that the proper combination of steel composition and hot-rolling conditions produced a softened steel sheet without coarsening crystal grains.

Moreover, we have discovered that heat treating the product coil during coating-baking or film lamination at a rather higher temperature for a shorter time causes softening (decreased strength) and improved formability in the steel. The present invention is based on these findings.

The present invention provides a method for making a steel sheet suitable for can making, which includes a step of hot rolling a steel slab to a strip less than about 1.2 mm, the steel slab comprising, about 0.002 weight percent or less of carbon, about 0.02 weight percent or less of silicon, about 0.5 weight percent or less of manganese, about 0.02 weight percent or less of phosphorus, about 0.01 weight percent or less of sulfur, about 0.15 weight percent or less of aluminum, about 0.005 weight percent or less of nitrogen, and the balance iron and incidental impurities.

The invention further includes a step for coiling the strip into a coil at a temperature range between about 600° and 750° C., a step for pickling the coil with an acid, and a step for cold rolling the coil at a rolling reduction rate of about 50 to 90 percent.

In another embodiment of the present invention, there is provided a method for making a steel sheet suitable for can making wherein the steel slab described above further comprises at least one component selected from the group consisting of about 0.002 to 0.02 weight percent of niobium, about 0.005 to 0.02 weight percent of titanium, and about 0.0005 to 0.002 weight percent of boron.

In still another embodiment of the present invention, there is provided a method for making a steel sheet suitable for can making wherein the steel slab described in either of the embodiments set forth above further comprises about 0.1 to 0.5 weight percent of chromium.

The present invention also provides a steel sheet suitable for can making produced in accordance with one of embodiments set forth above.

Additional embodiments with their variations, advantages and features of the present invention are described in, and will become apparent from the detailed description and the drawing provided below.

BRIEF DESCRIPTION OF THE DRAWINGS

The FIGURE is a graph showing the relationship of the tensile strength (TS), C and the reduction rate at cold rolling.

DETAILED DESCRIPTION OF THE PREFERRED EMBODIMENTS

Figure 1:
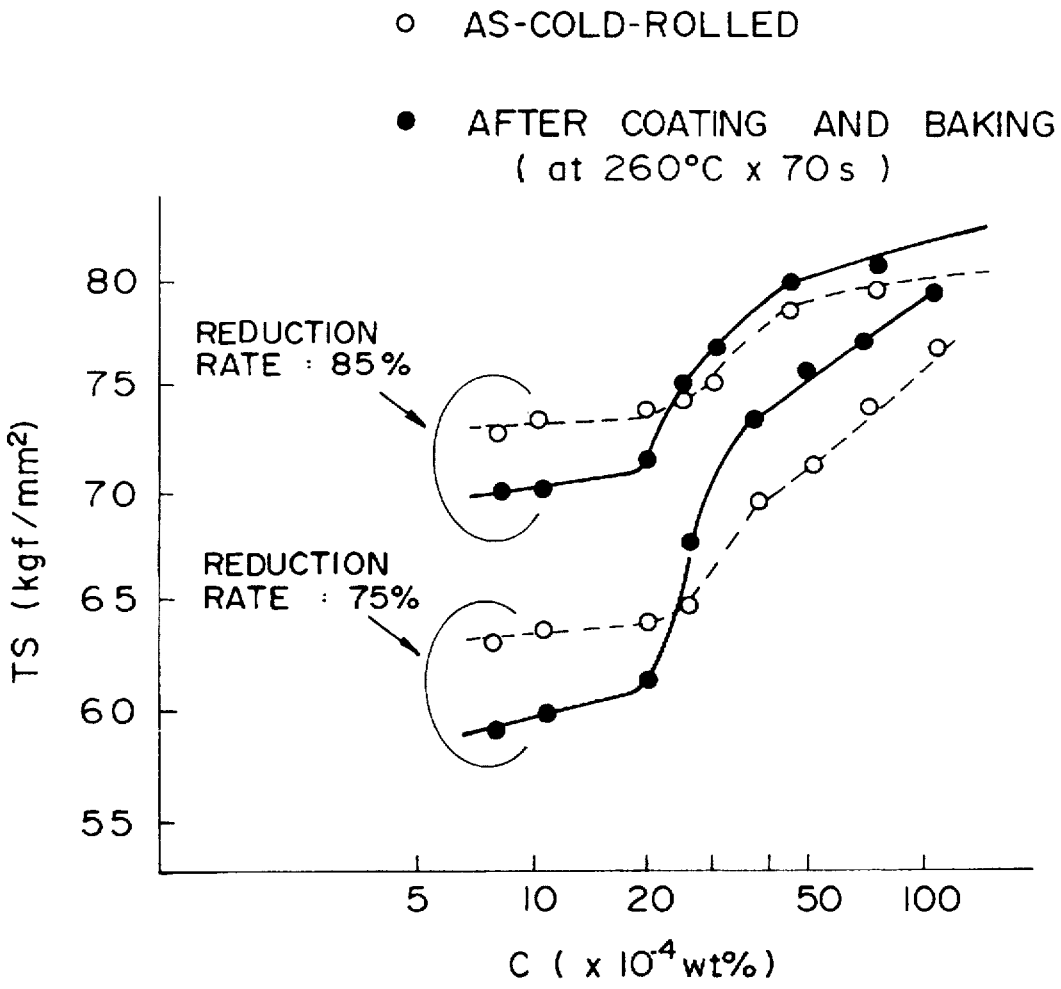

The component ranges for the steel sheet of the present invention will now be explained.

Carbon: about 0.002 weight percent or less

The strength of the hot-rolled steel strip decreases and the strength of the cold-rolled steel sheet further decreases by controlling the carbon content to about 0.002 weight percent or less. Moreover, the steel sheet noticeably softens through a heating such as through a coating-baking or a film lamination. Thus, the formability is further improved during plastic deformation. Such improvements are thought to be caused by a decrease in dissolved residual carbon. The local ductility is also improved by such control of the carbon content, resulting in fewer invitation sites of cracks during the flanging step. Thus, the carbon content is set at less than about 0.002 weight percent, and preferably less than about 0.0015 weight percent. Moreover, less than about 0.001 weight percent of carbon content is more preferable in view of extension-flanging property.

Silicon: about 0.02 weight percent or less

A silicon content exceeding about 0.02 weight percent causes hardening of the steel sheet and a generally poor surface state. Further, the resistance to the deformation during cold rolling and hot rolling increases, thus resulting in an unstable production operation. In addition, excess silicon increases the strength of the final product to an unacceptable level. Thus, the upper limit of the silicon content is set at about 0.02, and preferably about 0.01 weight percent. While the lower limit of the silicon content is not particularly restricted, practical refining limits are around 0.005 weight percent.

Mn: about 0.5 weight percent or less

Although manganese prevents red shortness caused by the fixation of sulfur, a content over about 0.5 weight percent decreases hot-rolling ductility due to a hardening of the steel, and causes unsatisfactory hardening of the cold-rolled steel sheet during the coating-baking step. Thus, the manganese content is controlled to about 0.5 weight percent or less, and preferably about 0.1 weight percent or less in view of formability. While the lower limit of the manganese content is not particularly restricted, practical refining limits are around 0.05 weight percent.

Phosphorus: about 0.02 weight percent or less

Since phosphorus decreases corrosion resistance and formability after coating-baking, it is desirable that its content does not exceed about 0.02 weight percent or less, and preferably about 0.01 weight percent or less. While the lower limit of the phosphorus content is not particularly restricted, practical refining limits are around 0.005 weight percent.

Sulfur: about 0.01 weight percent or less

Since sulfur is a harmful element which increases the amount of inclusions in the steel and causes decreased formability, especially regarding the flanging property, it is desirable that its content does not exceed about 0.01 weight percent or less, and preferably about 0.007 weight percent or less. While the lower limit of the sulfur content is not particularly restricted, practical refining limits are around 0.002 weight percent.

Aluminum: about 0.150 weight percent or less

Aluminum is added into the steel as a deoxidizer to improve the purity of the steel. The desirable lower limit of the aluminum content is approximately 0.05 weight percent or more. However, an Al content over about 0.15 weight percent will not result in further purity improvements, but causes hardening of the steel, increased production costs and surface defects. Therefore, the aluminum content is desirably about 0.15 weight percent or less, and preferably about 0.1 weight percent or less.

Nitrogen: about 0.005 weight percent or less

Because nitrogen causes an increased aging index and decreased formability due to increased amounts of nitrogen in solid solution, the least possible nitrogen content is desired. In particular, a nitrogen content over about 0.005 weight percent amplifies such harmful effects. Thus, the nitrogen content is limited to about 0.005 weight percent or less, and preferably 0.003 weight percent or less. While the lower limit of the nitrogen content is not particularly restricted, practical refining limits are around 0.0010 weight percent.

Niobium, titanium, boron and chromium are desirable components for making a steel sheet suitable as a material for can-making but not essential.

Niobium: about 0.002 to 0.02 weight percent

Niobium effectively promotes the formation of a homogeneous fine structure in the steel, prevents ridging, and decreases the aging property. In order to achieve such effects, at least about 0.002 weight percent of niobium can be added into the steel. However, niobium contents over about 0.02 weight percent increases deformation resistance during hot rolling and creates difficulty in the thin hot-rolling sheet production. Further, since the homogeneity of the structure in the steel decreases during hot rolling, such properties are not suitable for can-making materials. Thus, the niobium content of the invention ranges from about 0.002 to 0.02 weight percent, and preferably from about 0.005 to 0.01 weight percent.

Titanium: about 0.005 to 0.02 weight percent

Titanium effectively promotes the formation of a homogeneous fine structure in the steel, and causes a desirable adjustment in the aging property due to the partial fixation of carbon. Although such effects can be produced by additions over at least about 0.005 weight percent, additions over about 0.02 weight percent do not increase the desirable effects, and cause deterioration of the surface properties of the steel sheet. Thus, the titanium content of the invention ranges from about 0.005 to 0.02 weight percent, and preferably from about 0.007 to 0.015 weight percent.

Boron: about 0.0005 to 0.002 weight percent

Since boron can fix nitrogen in an extremely stable form, it contributes to the homogenization of the material. Further, boron can form a thermally stable structure in the steel sheet. For example, the extraordinary coarsening of the structure in the steel can be effectively suppressed during welding in the can-production process through the addition of boron. Thus, the boron content of the invention ranges from about 0.0005 to 0.002 weight percent, and preferably from about 0.0010 to 0.0015 weight percent.

Chromium: about 0.1 to 0.5 weight percent

Chromium decreases the strength of the steel, although the precise mechanism is not known. Such softening can be produced by the addition of over about 0.1 weight percent Cr. On the other hand, a Cr content exceeding about 0.5 weight percent causes undesirable hardening. A small quantity of chromium also improves the corrosion resistance of the steel sheet. Thus, the chromium content of the invention ranges from about 0.1 to 0.5 weight percent, and preferably from about 0.2 to 0.3 weight percent.

The process conditions in accordance with the present invention will now be explained.

Hot-rolling conditions

In the hot-rolling step, a cast slab (a continuous cast slab is preferable because of its lower cost) with or without reheating must be hot rolled to a strip having a final thickness of less than about 1.2 mm, and the strip must be coiled at a temperature ranging from about 600° to 750° C.

By controlling the final thickness to less than about 1.2 mm, stable mechanical properties can be attained irrespective of the hot-rolling temperature. Further, the strength after pickling and cold rolling is lower than that of the case using a thicker strip, thus resulting in the excellent formability. These discoveries were made through studies performed on a practical high-speed hot rolling plant. Such effects are thought to be produced by metallurgical changes such as recrystallization, recovery, and grain growth, as well as by geometrical effects such as remarkable homogenization of the microstructure in the sheet thickness direction, when an ultrathin hot-rolling steel sheet is produced through a practical high-speed hot rolling plant which is used for mainly thin steel sheets. To achieve the remarkable benefits of the invention, it is important that the final thickness after finishing rolling is controlled to less than about 1.2 mm, where other conditions such as the process for producing the slab or sheet bar and the slab thickness, and the rolling schedule of the rough rolling can be practically ignored. Accordingly, the final thickness after hot rolling in the invention is less than about 1.2 mm.

Although it is preferable that the temperature at the finishing rolling be as high as possible in order to make a finer structure, it is practically set at a range from about 750° to 950° C.

The coiling temperature is an important factor for softening the hot-rolled steel sheet. When the coiling temperature after hot rolling is less than about 600° C., softening of the steel sheet can not be achieved. When a softer material is required, the coiling temperature is desirably set at about 640° C. or more. However, when coiling at a temperature over about 750° C., coil deformation and surface property deterioration are observed in conjunction with the increase in scale thickness. Thus, the coiling temperature is controlled to a range from about 600° to 750° C., and preferably about 640° to 680° C.

The heating temperature and hot-rolling finishing temperature are not limited in the present invention. Although any conventional pickling step may be used, additional descaling means are preferably utilized so as to improve the descaling efficiency in order to offset the slight increase in the scale thickness seen in the present invention. Effective examples for descaling include controlling the scale composition by means of forced cooling, such as water cooling after coiling, and the introduction of micro-cracks in the scale layer by the leveling forming at an expedient range of the inlet side of the pickling line.

Cold-rolling conditions

The hot-rolled strip after pickling is cold rolled at a rolling reduction rate of about 50 to 90 percent. At a rolling reduction rate below about 50 percent, the steel sheet shape becomes unstable after cold rolling, and the surface roughness of the steel sheet becomes virtually uncontrollable. Thus, the lower limit of the rolling reduction rate is set at about 50 percent. On the other hand, cold rolling at a rolling reduction rate over about 90 percent causes deteriorated ductility due to hardening of the steel sheet. Such a steel sheet is unfit as a can material, and increases the load during the rolling process itself. Thus, the upper cold-rolling reduction limit is set at about 90 percent, and is preferably about 85 percent.

When the thickness of the cold-rolled steel sheet is about 0.50 mm or less, the benefits of the present invention are enhanced. A cold-rolled steel sheet having a thickness greater than about 0.50 mm is generally not suitable for applications requiring higher formability, even when the sheet possesses a low elongation in accordance with the present invention. Achieving adequately low strength for a cold-rolled steel sheet more than about 0.50 thick is difficult.

The effects of the present invention are further enhanced when the steel sheet has a tensile strength of about 75 $kg/mm^2$ or less, and preferably about 72 $kg/mm^2$ or less. A tensile strength greater than about 75 $kg/mm^2$ causes increased "spring back" during the can-manufacturing process, such that deteriorated form retaining property is anticipated. The Rockwell hardness (JIS Z2245) has been conventionally used as a parameter of the strength of thin steel sheets used in cans. However, since there are great deviations in the measured hardness data for such a thin material, the data is not reliable. Further, the hardness does not correspond to the amount of spring back and the number of unsatisfactorily formed units in the can-production process. In contrast, it is evident from a series of studies that the tensile strength closely corresponds to these properties.

Although the mechanism behind the softening of the steel sheet caused by heating (such as in a coating-baking) is not precisely understood, the softening may be a so-called recovery phenomenon. It is thought that the softening is the result of a decrease in the inhibiting factors to the recovery phenomenon caused by the decreased content of impurities such as carbon.

The heating temperature directly affects the softening in accordance with the above explanation. The degree of softening increases with the elevated temperature. A higher heating temperatures during coating-baking or hot melt laminating results in a softer steel sheet, thereby further improving formability.

Many steel sheets to be used in cans are subject to one or more heating steps including drying or baking after coating, and then are formed. Thus, the softening before forming and the resulting ease of formability achieved through the present invention confer significant industrial benefit.

The method of the present invention is primarily intended to produce steel sheets for relatively light forming. However, since products produced in accordance with the invention have properties similar to those of conventional products, such steel sheets are applicable to other expedient forming processes, e.g., deep drawing. Any surface treatment, for example, chromium plating for a tin-free steel sheet or lamination of an organic film, can be applied before heating without limitation.

The invention will now be described through illustrative examples. The examples are not intended to limit the scope of the invention defined in the appended claims.

In addition, such a treatment as the high temperature reblow treatment in a tin plating line is advantageous to reduce the strength of steel sheets.

EXAMPLE 1

Steel slabs, each having a thickness of 220 to 280 mm, were obtained by melting various steel having compositions as shown in Table 1. The slabs were reheated to temperatures ranging from 1,180° to 1,280° C., hot rolled under the conditions shown in Table 2, and cold rolled to form a cold-rolled steel sheet. After the cold-rolled sheets were subject to ordinary tin-electroplating (corresponding to 15#), their properties were evaluated.

TABLE 1

| | Chemical Compositions (wt %) | | | | | | | | |
|---|---|---|---|---|---|---|---|---|---|
| Steel | C | Si | Mn | P | S | N | Al | Others | Remarks |
| A | 0.0009 | 0.009 | 0.09 | 0.007 | 0.002 | 0.0015 | 0.076 | — | Example of the Invention |
| B | 0.0016 | 0.005 | 0.05 | 0.010 | 0.005 | 0.0020 | 0.045 | — | Example of the Invention |
| C | 0.0012 | 0.010 | 0.30 | 0.009 | 0.002 | 0.0030 | 0.085 | Cr: 0.1 | Example of the Invention |
| D | 0.0007 | 0.015 | 0.25 | 0.012 | 0.010 | 0.0015 | 0.028 | Nb: 0.007 | Example of the Invention |
| E | 0.0015 | 0.013 | 0.05 | 0.013 | 0.005 | 0.0034 | 0.045 | Ti: 0.007 | Example of the Invention |
| F | 0.0012 | 0.013 | 0.79 | 0.013 | 0.005 | 0.0028 | 0.045 | Nb: 0.008<br>Ti: 0.005<br>B: 0.0010 | Example of the Invention |
| G | 0.0030 | 0.013 | 0.05 | 0.013 | 0.005 | 0.0068 | 0.045 | — | Comparative Example |
| H | 0.0017 | 0.013 | 0.95 | 0.013 | 0.005 | 0.0034 | 0.045 | — | Comparative Example |

The slabs were subjected to hot rolling with a practical (manufacturing-grade) hot-rolling plant provided with a three-stand rough rolling mill and seven-stand tandem rolling mill. The inlet thickness of the finishing rolling mill was set at 35 mm and average speed at finishing rolling was set to 1,000 mpm. Cold rolling was carried out by a practical tandem rolling mill with six stands at an ordinary operation speed.

Physical properties of the resulting steel sheet were evaluated as follows:

Tensile Strength (TS): A test piece having a width of 12.5 mm, a length of 30 mm, and a distance between marks of 25 mm was stretched at a speed of 10 mm/min using an Instron type universal tester.

Rupture Cross Section Reduction: After the test of the tensile strength was performed as set forth above, the area of the rupture cross section was determined after optical enlargement. The rupture cross section reduction is defined as the percentage reduction in area as compared to the original area before the tensile strength test. The larger the rupture cross section reduction, the better the local ductility. It is confirmed that the local ductility closely corresponds to the ductility on a high speed forming process, such as a process for producing cans.

ΔYS (Yield Strength): The difference of YS (Yield Strength) values at the tensile test before heat treatment and after heat treatment was determined on the surface treated steel sheets or original sheets. The heat treatment was carried out at 220° C. for 10 minutes. Aging was evaluated by using the result in the present invention.

Ridging: After the steel sheet was stretched by 10 percent in the direction perpendicular to the rolling direction, ridge or ridges formed on the surface were observed. The observed ridge(s) closely corresponds with the poor appearance of cans produced in an actual production line.

In addition, the corrosion was observed for steel sheets after cold rolling in accordance with the present invention and steel sheets produced by a conventional cold-rolling/annealing/temper-rolling process, after these steel sheets were coated with a rust resisting oil in the amount of 3 g/m$^2$ and were permitted to stand for three months in an indoor atmosphere.

Results are summarized in Table 2.

invention is suitable for cans. It is thought that impurity elements concentrated on the sheet surface during annealing initiate corrosion in the conventional steel sheet, while the corrosion due to such surface impurity concentrations is suppressed in the steel sheet in accordance with the present invention, which does not include an annealing step and uses a highly purified raw material.

EXAMPLE 2

From the steel strip A shown in Table 1, a cold-rolled sheet having a thickness of 0.180 mm was produced, and was subject to tin-plating equivalent to #25 under conventional conditions. After coating-baking at 235° C. for 15 minutes, the plated sheet was subject to roll forming and high speed seam welding so as to form a barrel of a three-piece can. After the flange section was subjected to stretching flanging with an expansion of 15% by using a truncated conical punch, roll-formability and cracks after flanging were evaluated. A flange forming test as performed on conventional 350 ml can was then carried out. Examples in which 5 or more samples having a crack in the welding

TABLE 2

| | | Hot-Rolling Conditions | | | | | Properties | | | | | |
|---|---|---|---|---|---|---|---|---|---|---|---|---|
| | | Final | Coiling | Finishing | Cold Rolling | | Tensile | | | | | |
| No | Steel | Temp. (°C.) | Temp. (°C.) | Thickness (mm) | Reduction Rate (%) | Thickness (mm) | Strength (kgf/mm$^2$) | ΔYS (kgf/mm$^2$) | Rupture C-S Reduction (%) | Ridging | Others | Remarks |
| 1 | A | 890 | 680 | 1.0 | 85 | 0.15 | 69 | −5 | 97 | None | | Example of the Invention |
| 2 | A | 840 | 640 | 0.8 | 80 | 0.16 | 66 | −4 | 95 | None | | Example of the Invention |
| 3 | A | 800 | 700 | 1.1 | 86 | 0.15 | 70 | −5 | 96 | None | | Example of the Invention |
| 4 | B | 820 | 700 | 1.1 | 82 | 0.19 | 66 | −3 | 95 | None | | Example of the Invention |
| 5 | C | 780 | 690 | 0.7 | 65 | 0.24 | 59 | −3 | 96 | None | | Example of the Invention |
| 6 | D | 830 | 680 | 1.0 | 80 | 0.20 | 68 | −3 | 94 | None | | Example of the Invention |
| 7 | E | 890 | 710 | 1.0 | 72 | 0.28 | 63 | −4 | 94 | None | | Example of the Invention |
| 8 | F | 870 | 640 | 0.9 | 86 | 0.13 | 70 | −3 | 92 | None | | Example of the Invention |
| 9 | G | 870 | 670 | 1.1 | 86 | 0.15 | 83 | +1 | 88 | Found | | Comparative Ex. |
| 10 | H | 860 | 670 | 1.1 | 86 | 0.15 | 82 | +1 | 87 | None | | Comparative Ex. |
| 11 | A | 890 | 530 | 1.1 | 86 | 0.15 | 77 | +2 | 85 | None | * | Comparative Ex. |
| 12 | A | 890 | 640 | 1.3 | 87 | 0.17 | 78 | 0 | 87 | None | ** | Comparative Ex. |

* An unsatisfactory shape was found after cold rolling.
** Excessive spring back was observed during forming.

Table 2 reveals that in steel sheet produced in accordance with the method of the present invention, neither ridging nor excessive spring back during forming is observed. Further, the steel sheet shows excellent properties suitable for its formability in that TS is less than about 75 kg/mm$^2$, YS decreases from a heat treatment equivalent to the coating-baking step, and the rupture cross section reduction increases.

The corrosion resistance of the steel sheet in accordance with the method of the present invention were observed to be clearly superior to that of conventionally produced sheets. The corrosion resistance observed after six months again showed the same relative performance. These results illustrate that the steel sheet in accordance with the present section due to heat were found among 50 samples were considered unsatisfactory and are marked with an "X" in Table 3, while those having less than 5 of 50 samples exhibiting a welding crack are marked with an "○." Regarding the roll forming property, examples exhibiting local bending or stretcher strain due to roll forming were considered unsatisfactory (x), or tolerable (Δ). Examples not exhibiting either local bending or stretcher strain due to roll forming were considered satisfactory (○).

Table 3 indicates that the steel sheets in accordance with the present invention satisfy all characteristics required for the process for making cans.

TABLE 3

| | | Hot-Rolling Conditions | | | Cold- | Properties | | | | |
|---|---|---|---|---|---|---|---|---|---|---|
| No. | Steel | Final Temp. (°C.) | Coiling Temp. (°C.) | Finishing Thickness (mm) | Rolling Condition Rate (%) | Tensile Strength (kgf/mm$^2$) | Roll Forming | Flange Crack | HAZ Crack | Remarks |
| 1 | A | 840 | 660 | 2.0 | 91 | 82 | x | x | None | Comparative Ex. |
| 2 | A | 840 | 660 | 1.8 | 90 | 74 | Δ | x | None | Comparative Ex. |
| 3 | A | 840 | 660 | 1.1 | 84 | 71 | ○ | ○ | None | Example of the Invention |
| 4 | A | 840 | 660 | 0.9 | 80 | 68 | ○ | ○ | None | Example of the Invention |

EXAMPLE 3

Steels having the composition of steel A in Table 1 except for carbon, which was adjusted to various levels, were hot rolled to a final thickness of 0.8 mm with a coiling temperature of 650° C., were pickled, and were cold rolled under a rolling reduction rate of 75 percent or 85 percent. The tensile strength of each of steel sheets before and after coating-baking at 260° C. for 70 seconds was measured.

Results are shown in FIG. 1. FIG. 1 illustrates that when the carbon content is less than about 0.0020 weight percent or when the cold-rolling reduction rate is expedient, the steel sheet has a practical strength suitable for forming and durable to the use for cans.

When the carbon content is out of the range of the present invention, the steel sheet is impractical due to the flange crack formation and poor roll forming property, even at the decreased cold-rolling reduction rate.

According to the present invention, a steel sheet for cans, which is softened after the heat treatment at low temperature and has excellent formability, can be produced without any additional equipment, resulting in a highly efficient, inexpensive production method for steel sheet for cans having excellent formability.

Although this invention has been described with reference to specific forms of apparatus and method steps, equivalent steps may be substituted, the sequence of the steps may be varied, and certain steps may be used independently of others. Further, various other control steps may be included, all without departing from the spirit and scope of the invention defined in the appended claims.

What is claimed is:

1. An annealing free method for making a steel sheet suitable as a material for can making, comprising:

forming a steel slab containing about 0.002 weight percent or less of carbon,
about 0.02 weight percent or less of silicon,
about 0.5 weight percent or less of manganese,
about 0.02 weight percent or less of phosphorus,
about 0.01 weight percent or less of sulfur,
about 0.15 weight percent or less of aluminum,
about 0.005 weight percent or less of nitrogen, and
the balance iron and incidental impurities;

hot rolling said steel slab to form a strip having a thickness of less than about 1.2 mm, coiling said strip into a coil at a temperature in the range of about 600° and 750° C.;

pickling said coil; and cold rolling said coil at a rolling reduction rate of 50 to 90 percent without subsequent annealing.

2. A method according to claim 1, wherein said steel slab further comprises at least one component selected from the group consisting of about 0.002 to 0.02 weight percent of niobium,
about 0.005 to 0.02 weight percent of titanium, and
about 0.0005 to 0.002 weight percent of boron.

3. A method according to claim 1, wherein said steel slab further comprises about 0.1 to 0.5 weight percent of chromium.

4. A method according to claim 2, wherein said steel slab further contains about 0.1 to 0.5 weight percent of chromium.

5. A method according to claim 1, wherein said steel slab contains about 0.001 weight percent or less of carbon.

6. A method according to claim 1, wherein said steel slab contains about 0.001 weight percent or less of carbon,
about 0.01 weight percent or less of silicon,
about 0.1 weight percent or less of manganese,
about 0.01 weight percent or less of phosphorus,
about 0.007 weight percent or less of sulfur,
about 0.1 weight percent or less of aluminum,
about 0.003 weight percent or less of nitrogen, and
the balance iron and incidental impurities.

7. A method according to claim 1, wherein said thickness of said strip is 1.0 mm or less.

8. A method according to claim 1, wherein said temperature range for said coiling of said strip is from about 640° to 680° C.

9. A method according to claim 1, wherein said rolling reduction rate is from about 50 to 85 percent.

10. A steel sheet for can making, said sheet being produced in accordance with any one of claims 1 through 9.

11. A method for making a steel sheet suitable as a material for can making consisting essentially of:

forming a steel slab containing about 0.002 weight percent or less of carbon,
about 0.02 weight percent or less of silicon,
about 0.5 weight percent or less of manganese,
about 0.02 weight percent or less of phosphorus,
about 0.01 weight percent or less of sulfur,
about 0.15 weight percent or less of aluminum,
about 0.005 weight percent or less of nitrogen, and
the balance iron and incidental impurities;

hot rolling said steel slab to form a strip having a thickness of less than about 1.2 mm, coiling said strip into a coil at a temperature in the range of about 600° and 750° C. without heat retention;

pickling said coil; and cold rolling said coil at a rolling reduction rate of 50 to 90 percent without subsequent annealing.

12. A method according to claim 11, wherein said steel slab further comprises at least one component selected from the group consisting of about 0.002 to 0.02 weight percent of niobium, about 0.005 to 0.02 weight percent of titanium, and about 0.0005 to 0.002 weight percent of boron.

13. A method according to claim 11, wherein said steel slab further comprises about 0.1 to 0.5 weight percent of chromium.

14. A method according to claim 12, wherein said steel slab further contains about 0.1 to 0.5 weight percent of chromium.

15. A method according to claim 11, wherein said steel slab contains about 0.001 weight percent or less of carbon.

16. A method according to claim 11, wherein said steel slab contains about 0.001 weight percent or less of carbon, about 0.01 weight percent or less of silicon, about 0.1 weight percent or less of manganese, about 0.01 weight percent or less of phosphorus, about 0.007 weight percent or less of sulfur, about 0.1 weight percent or less of aluminum, about 0.003 weight percent or less of nitrogen, and the balance iron and incidental impurities.

17. A method according to claim 11, wherein said thickness of said strip is 1.0 mm or less.

18. A method according to claim 11, wherein said temperature range for said coiling of said strip is from about 640° to 680° C.

19. A method according to claim 11, wherein said rolling reduction rate is from about 50 to 85 percent.

20. A steel sheet for can making, said sheet being produced in accordance with claim 11.

* * * * *